US007395832B2

(12) United States Patent
Behruzi et al.

(10) Patent No.: US 7,395,832 B2
(45) Date of Patent: Jul. 8, 2008

(54) FUEL TANK FOR SPACECRAFT

(75) Inventors: Kei P. Behruzi, Bremen (DE); Mark Michaelis, Bremen (DE); Gaston Netter, Vollersode (DE)

(73) Assignee: EADS Space Transportation GmbH, Bremen (DE)

( * ) Notice: Subject to any disclaimer, the term of this patent is extended or adjusted under 35 U.S.C. 154(b) by 237 days.

(21) Appl. No.: 11/472,627

(22) Filed: Jun. 21, 2006

(65) Prior Publication Data

US 2007/0084509 A1 Apr. 19, 2007

(30) Foreign Application Priority Data

Jul. 28, 2005 (DE) ..... 10 2005 035 356

(51) Int. Cl.
*B67D 5/54* (2006.01)

(52) U.S. Cl. ..... 137/154; 137/590; 244/172.2; 244/172.3

(58) Field of Classification Search ..... 137/140, 137/154, 171, 177, 590, 592; 244/172.3, 244/172.2, 135 R, 158 R; 96/187, 204, 206; 95/260; 55/413
See application file for complete search history.

(56) References Cited

U.S. PATENT DOCUMENTS

| | | | | |
|---|---|---|---|---|
| 2,163,988 | A | 6/1939 | Stacey | |
| 2,943,815 | A * | 7/1960 | Besson | 244/14 |
| 3,315,845 | A * | 4/1967 | Vaiden | 222/95 |
| 3,854,905 | A | 12/1974 | Balzer et al. | |
| 4,399,831 | A | 8/1983 | Robert | |
| 4,489,745 | A | 12/1984 | Netter et al. | |
| 4,733,531 | A | 3/1988 | Grove | |
| 4,743,278 | A | 5/1988 | Yeh | |
| 4,768,541 | A * | 9/1988 | Uney et al. | 137/154 |
| 4,790,350 | A * | 12/1988 | Arnold | 137/588 |
| 4,976,398 | A | 12/1990 | Bruhn | |
| 5,240,038 | A * | 8/1993 | Canedi | 137/574 |
| 5,293,895 | A | 3/1994 | Grove et al. | |
| 6,014,987 | A * | 1/2000 | List et al. | 137/549 |
| 2007/0145194 | A1 | 6/2007 | Behruzi et al. | |

FOREIGN PATENT DOCUMENTS

| | | |
|---|---|---|
| CA | 683 854 | 4/1964 |
| DE | 31 46 262 | 5/1983 |
| DE | 100 40 755 | 3/2002 |
| DE | 101 17 557 | 10/2002 |

* cited by examiner

*Primary Examiner*—John Rivell
*Assistant Examiner*—Craig Price
(74) *Attorney, Agent, or Firm*—W. F. Fasse; W. G. Fasse

(57) ABSTRACT

A fuel tank for a spacecraft stores a liquid fuel and a pressurized propellant gas that drives the fuel out of the tank through a fuel extraction arrangement including a reservoir or collection container and a tank outlet. The collection container bounds a fuel reservoir space that communicates with the interior space of the tank, and fuel flow channels connect the reservoir space to an outlet pipe. A side or area of the collection container opposite the fuel flow channels is provided with one or more grooves. These structures produce a capillary pumping effect and use the surface tension to separate the fuel from the propellant gas.

15 Claims, 4 Drawing Sheets

FUEL TANK FOR SPACECRAFT

PRIORITY CLAIM

This application is based on and claims the priority under 35 U.S.C. §119 of German Patent Application 10 2005 035 356.8, filed on Jul. 28, 2005, the entire disclosure of which is incorporated herein by reference.

FIELD OF THE INVENTION

The invention relates to a fuel tank, and especially such a tank for storing aggressive liquid fuels for operation of spacecraft.

BACKGROUND INFORMATION

Spacecraft such as rockets, shuttles, satellites, orbital stations, and other bodies flying in space are typically outfitted with suitable containers or fuel tanks for storing liquid fuels that are used to power the engines, including engines or thrusters for carrying out apogee maneuvers as well as position regulation in space. In order to drive or propel the liquid fuel out of the fuel tank, the fuel tank is typically also charged with a pressurizing gas or propellant gas, which serves to pressurize the fuel and drive the fuel to the combustion or reaction chambers of the engines. Inert gases such as helium (He) or nitrogen ($N_2$) are typically used as the propellant gases, which are introduced under pressure into the fuel tank, and which thus serve to press the liquid fuel from the fuel tank into the piping system leading to the respective engine. The liquid fuel may be an aggressive storable liquid fuel such as MMH, $N_2O_4$, or hydrazine.

With such gas-charged fuel tanks, it is very important to achieve a complete, sure and reliable separation between the propellant gas serving as a conveying medium, and the liquid fuel that is conveyed or delivered to the engine. Namely, when the liquid fuel is delivered to the engine, it is crucial that the liquid fuel must be free of foreign gas inclusions or bubbles at the time of ignition of the fuel. Otherwise, the ignition of the fuel, and the reliable operation of the engine, could be jeopardized.

A fuel tank of the above described general type and operating according to the above described principle is known from the German Patent 100 40 755. Moreover, U.S. Pat. No. 5,293,895 discloses a fuel tank for use in space, whereby the outlet of the tank includes an arrangement of an outlet pipe connected with a reservoir or collection container via a plurality of bored holes.

A standard known method of separating liquids and gases from one another involves the use of screens or sieves, which block the throughflow of gases up to a certain pressure difference across the screen or sieve. Separating devices using such sieves, however, are relatively expensive and complicated. In small satellites with relatively low fuel volume delivery flows, it is possible to avoid the use of such relatively expensive sieves under certain circumstances. Namely, it is desirable to reduce the cost and complexity of the fuel separating arrangements if possible.

A special and often called-for requirement of such tanks is additionally the possibility of transporting the already-filled fuel tank in a horizontal orientation, while the tank is integrated in a satellite, as the satellite is transported to the launch location. This is especially significant, when limitations on the degree of tank filling are to be avoided. Due to dynamic effects, the forces arising during the transport can amount to or exceed a multiple of the forces arising due to normal earth's gravity. In the previously known tanks of this type, it has therefore either been necessary to limit the degree of tank filling in the direction of smaller or partial filling, so that the tank outlet would always be covered or surrounded with liquid, or been necessary to bound the tank outlet by a very narrow or tight channel, which, however, produces relatively high pressure losses when the fuel is withdrawn from the tank during operation. The maximum permissible pressure losses that can occur in that regard are typically prescribed.

A further requirement is the possibility that a satellite equipped with such a tank can be launched into orbit in an orientation perpendicular to the tank outlet. This possibility is especially pertinent for the transport of several small satellites that are arranged laterally horizontally on a central carrier structure. The high dynamic loads that arise during a rocket launch cause any exposed sieves or openings typically to loose their holding or retaining ability, that is to say an entry or penetration of the propellant gas into the outlet cannot be prevented. This leads to a failure if the fuel tank is not completely filled and sensitive components such as sieves and openings protrude out of the liquid. In that case, the propellant gas can penetrate through the sieves and openings to the tank outlet under high load conditions, which similarly lead to a failure of the engine. Therefore, with previously known tanks of the above described type, it has not been possible to carry out a rocket launch with a horizontally oriented tank.

SUMMARY OF THE INVENTION

In view of the above, it is an object of the invention, to provide a fuel tank for a spacecraft using surface tension of the fuel to achieve a separation of the fuel from a propellant gas, using a refillable reservoir or collection container arranged at a nominal bottom of the fuel tank. The invention aims to further develop such a fuel tank so that the fuel will be stably held in the fuel line even after a temporary horizontal orientation of the tank with a low tank filling level. The invention also aims to ensure a continuous bubble-free filling and re-filling of the collection container located in the tank. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a fuel tank for a spacecraft, of the general type discussed above, wherein the tank outlet is provided with bored holes or channels that connect an outlet pipe with the fuel reservoir or collection container, and wherein an area of the collection container lying opposite the bored holes or channels is provided with one or more grooves.

The manufacturing costs for the fuel tank according to the invention are practically not increased in comparison to the conventional tank construction. Thus, while the costs remain the same, the inventive arrangement achieves a considerable increase of the flexibility with respect to the handling of the fuel tank while on the ground and during the rocket launch. Namely, a greater flexibility as to the orientation of the tank and as to the degree or level of filling of the tank is achieved. With such a construction, the fuel tank according to the invention can achieve a secure reliable bubble-free supply of liquid fuel without using any sieves for separating the fuel from the propellant gas.

In order to improve the filling of the reservoir or collection container utilizing the capillary pumping effect, a preferred embodiment of the invention provides that the fuel reservoir or interior space of the collection container is configured with a wall, such as a conical wall, extending at an acute angle relative to a plane that extends perpendicularly to a symmetry axis of the tank extending through the outlet pipe.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF A PREFERRED EXAMPLE EMBODIMENT AND THE BEST MODE OF THE INVENTION

Figure 1:
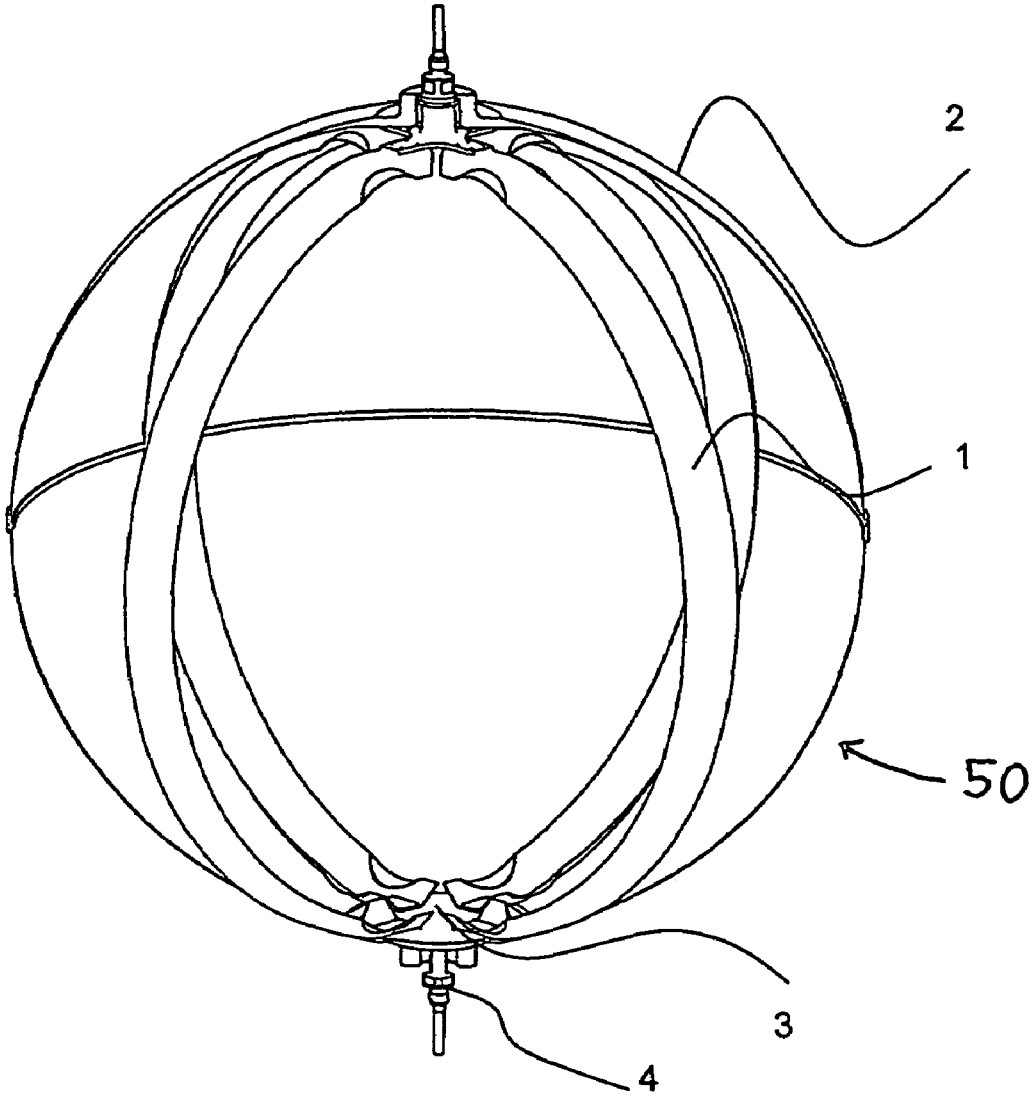
FIG. 1 is a cut-away perspective view of a fuel tank according to an example embodiment of the invention.

FIG. 1 generally shows a substantially spherical fuel tank 50 for a spacecraft, which is particularly a so-called surface tension tank for receiving and storing an aggressive storable liquid fuel, such as MMH, $N_2O_4$, or hydrazine. In this application, the term fuel can also or alternatively include an oxidizer. The tank is at least partially filled with such a liquid fuel (not shown) and further contains a pressurized propellant gas, which may typically be an inert gas such a helium (He) or nitrogen ($N_2$), which is also not shown. The pressurized propellant gas serves to pressurize and drive the liquid fuel out of the tank to an engine through a piping system (not shown).

The tank is bounded by a substantially spherical tank wall 2. In order to extract or withdraw the fuel out of the tank 50, the tank is equipped with a fuel extraction arrangement that makes use of the surface tension of the fuel to separate the fuel from the propellant gas, as follows. Four guide plates 1 are arranged along the tank wall for collecting and guiding the fuel, especially under weightless conditions. These guide plates 1 lead into a reservoir or collection container 3 arranged at a nominal bottom of the fuel tank 50. It should be understood, that the nominal "bottom" only pertains to a particular "upright" orientation of the tank while it is on the earth or at least under gravitational influence. The "bottom" could alternatively be oriented laterally toward the side (as will be discussed below in connection with FIG. 4), or has no defined positional meaning in a weightless environment.

Figure 2:
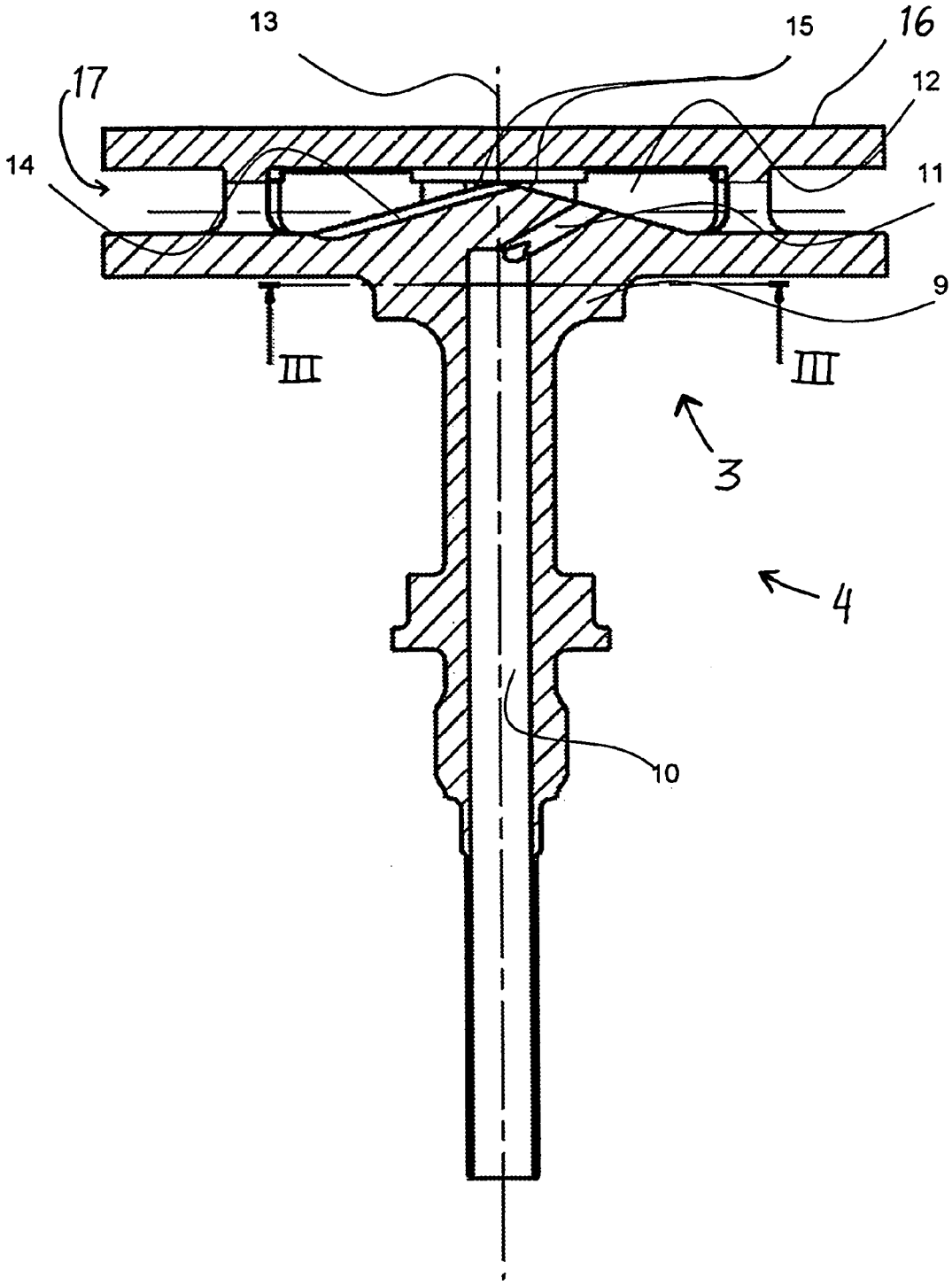
FIG. 2 is a sectional detail view of the tank outlet arrangement of the fuel tank according to FIG. 1.
Figure 3:
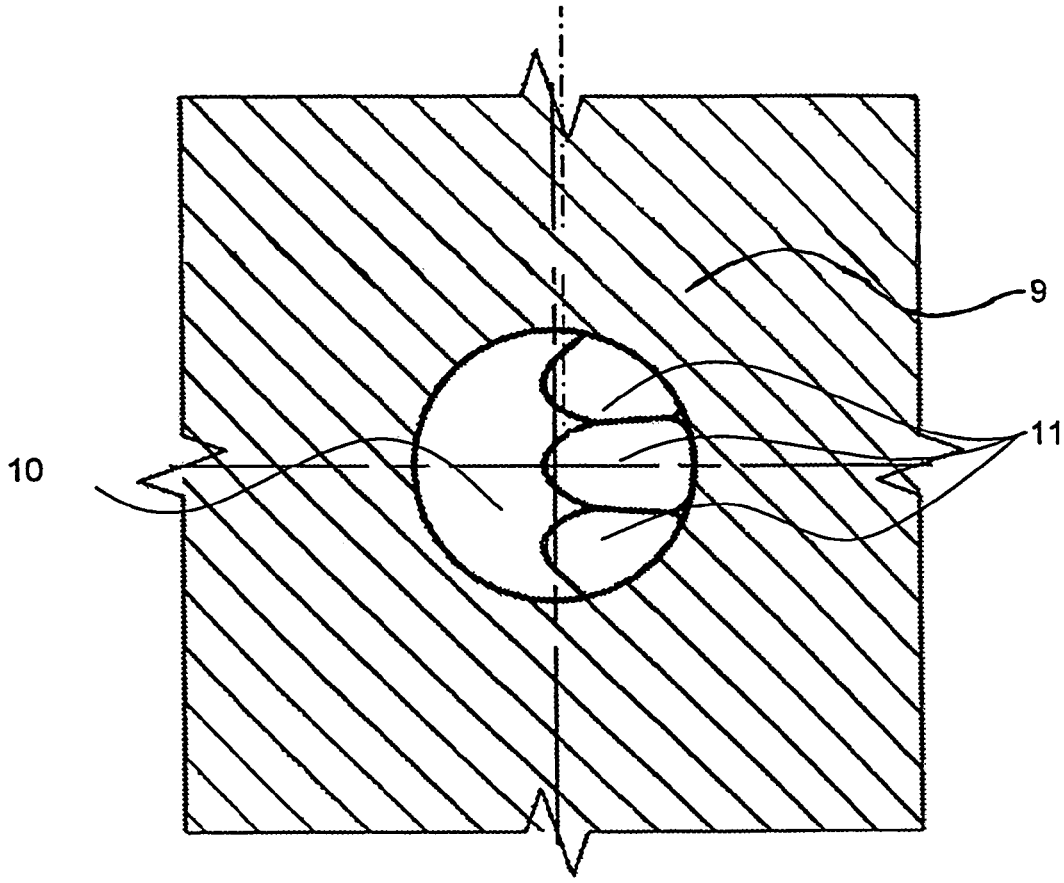
FIG. 3 is a sectional view along the section line III-III in FIG. 2.

The collection container 3 at the floor or bottom of the fuel tank 50 is connected and leads to a tank outlet 4 through which the fuel exits the tank to the piping system leading to the combustion or reaction chamber of the engine (not shown). FIGS. 2 and 3 show the reservoir or collection container 3 in detail. The bottom part 9 of the collection container 3 forming the tank outlet 4 is embodied as a rotationally turned part, whereby the manufacturing costs can be held low. The collection container 3 further includes a top part 16 in the manner of a generally disk-shaped plate that is spaced apart from the bottom part 9, to bound a fuel reservoir or interior space 12 therebetween. Fuel feed or flow passages 17 between the top part 16 and the bottom part 9 allow fuel from the tank interior space of the tank to enter into the fuel reservoir or interior space 12 of the collection container 3. Three fuel flow channels 11 are provided in the bottom part 9 to connect a centrally arranged outlet pipe 10 with the fuel reservoir or interior space 12 of the collection container 3. The outlet pipe 10 extends axially along a longitudinal axis 13 of the tank.

The three channels 11 each have a respective diameter of about 2 mm. The three channels 11 are all provided on one side or half of the collection container 3 relative to the axis 13, as can be seen in the sectional view of FIG. 3. The opposite side relative to the axis 13 does not have such channels 11. The channels 11 radiate or fan out from one another on the right side as shown in FIG. 3. Furthermore, as seen in the axial section of FIG. 2, the channels 11 extend along a sloping angle, e.g. along a conical section from the outlet pipe 10 into the interior space 12 of the collection container 3. On the left side of the collection container 3 opposite the channels 11 relative to the axis 13 as shown in FIG. 2, one or more one-sided cut-in or recessed grooves 14 are provided, to provide a capillary pumping action for conveying the liquid fuel (discussed below).

With this arrangement of the channels 11 and the groove or grooves 14, a filling of the tank in the horizontal orientation is thereby also possible if the channels 11 are oriented upwardly opposite earth's gravitational acceleration. Furthermore, the channels are sloped or tilted in such a manner so that no propellant gas bubbles will be enclosed or trapped during the first filling of the tank with fuel.

The bottom part 9 of the collection container 3 has a sloping portion, e.g. generally conical portion, protruding into and bounding the fuel reservoir or interior space 12 opposite the flat disk-shaped top part 16. This part is configured so that the interior space 12 has a geometry defined by an acute angle 15 relative to a plane extending perpendicularly to the symmetry or longitudinal axis 13 of the tank. The channels 11 open through this conical or angled portion into one side of the interior space 12, and the groove or grooves 14 extend along this angled or conical portion on the other side relative to the axis 13. With such a structure and configuration, the interior space 12 of the reservoir or collection container 3 can be filled and re-filled by itself in a complete and bubble-free manner with liquid fuel both during the rotation of the tank from the horizontal orientation into the vertical orientation, for example following a horizontal transport of the tank with a low tank filling level, as well as in a weightless condition. This filling of the interior space 12 is achieved due to the capillary effects, and is assisted or supported by the above-mentioned one-sided cut-in or recessed grooves 14. Thus, even in a weightless condition, when the fuel is not confined to the "bottom" end of the tank, the fuel reservoir or interior space 12 of the collection container 3 can be reliably and quickly filled with liquid fuel in a bubble-free manner due to the active capillary forces. This capillary pumping action is considerably improved due to the embodiment of the collection container interior space 12 with the above described acute angle 15.

Figure 4:
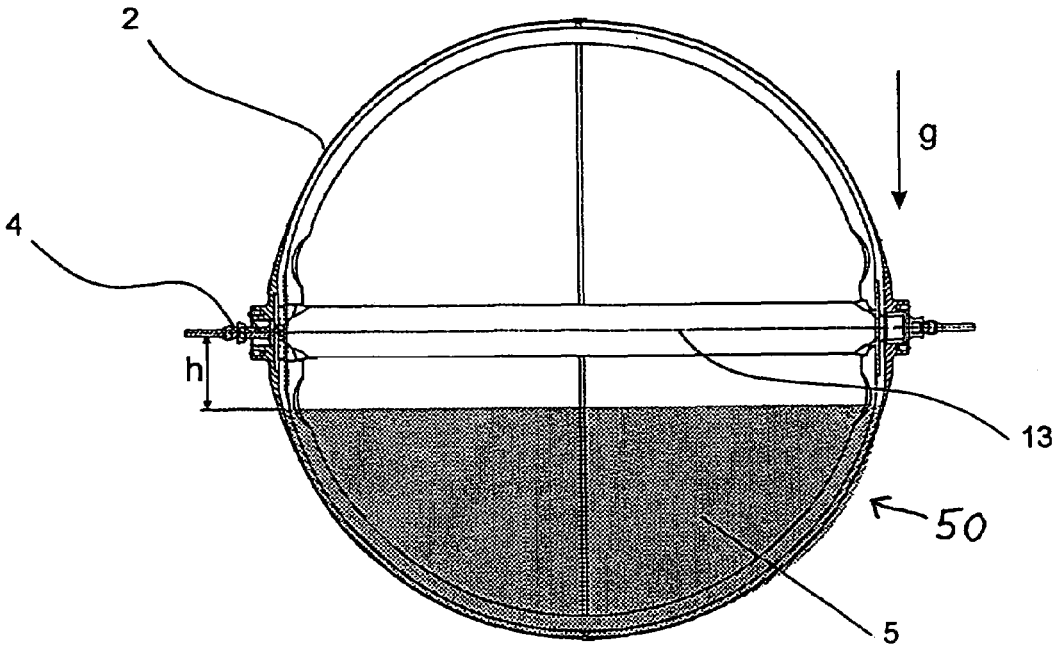
FIG. 4 is a vertical sectional view in the area of the longitudinal axis through the fuel tank according to FIG. 1, which is shown here oriented horizontally for a launch.

A filling of the tank with fuel is usually carried out with a vertically oriented tank, i.e. with the longitudinal axis 13 extending parallel to the direction of earth's gravitational field. In this orientation, the entire tank outlet 4 as well as the collection container 3 are completely covered by and filled with liquid fuel. If the tank 50 is subsequently tilted about the tank's crosswise axis, so that the three channels 11 are oriented opposite the effective acceleration, then the tank can also be horizontally transported with low tank filling levels. For example, as shown in FIG. 4, the filled fuel tank 50 according to FIG. 1 has been oriented horizontally for carrying out the subsequent transport. For example, the tank is arranged in a satellite that is being transported to the launch location, whereby the tank is oriented horizontally. In this position, the tank outlet 4 of the filled tank 50 is oriented perpendicularly to the direction of earth's gravitational acceleration illustrated by the arrow g in FIG. 4. Thus, the fuel 5 no longer covers and wets the tank outlet 4, especially if there is a relatively low filling level (less than half full). Instead, the fuel level is at a spacing h below the tank outlet 4.

The use of several channels 11 as described above in the tank outlet 4 additionally achieves a significantly reduced pressure loss at the tank outlet 4 during the extraction or expulsion of fuel from the tank, in comparison to the previously known tanks described above. In addition to the expanded field of application with respect to a horizontal orientation of the tank during transport and launch, the inventive structure of the tank outlet arrangement further provides a larger reserve with respect to the maximum tolerable pressure losses, as well as a faster filling and emptying of the tank on the ground.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A fuel tank for a spacecraft, for storing a liquid fuel and a pressurized propellant gas, said fuel tank comprising:

a tank wall enclosing a tank interior space adapted to store the liquid fuel and the propellant gas therein; and a fuel extraction arrangement that communicates out of said tank interior space through said tank wall, and that comprises a fuel collection container and an outlet pipe;

wherein:

said fuel collection container is arranged on said tank wall at an outlet location;

said fuel collection container defines therein a fuel reservoir space communicating with said tank interior space through fuel feed passages;

said outlet pipe extends from said fuel collection container outwardly away from said tank interior space; and said fuel collection container has plural fuel flow channels that communicate from said fuel reservoir space into said outlet pipe in a first area, and grooves in said fuel collection container adjoining said fuel reservoir space in a second area.

2. The fuel tank according to claim 1, wherein said fuel collection container including said grooves, said fuel flow channels and said fuel reservoir space are configured, dimensioned and arranged to achieve a separation of the liquid fuel from the propellant gas due to a surface tension of the liquid fuel.

3. The fuel tank according to claim 1, wherein said fuel flow channels are respective bored holes.

4. The fuel tank according to claim 1, wherein said plural fuel flow channels include one or more said fuel flow channels that fan out relative to one another from said outlet pipe to said fuel reservoir space.

5. The fuel tank according to claim 1, wherein said first area having said fuel flow channels is located opposite said second area having said grooves, with respect to a longitudinal axis extending along said outlet pipe.

6. The fuel tank according to claim 1, wherein said first area is devoid of said grooves and said second area is devoid of said fuel flow channels.

7. The fuel tank according to claim 1, wherein said first area comprises a first half of said fuel collection container and said second area comprises a second half of said fuel collection container respectively located on opposite sides of a longitudinal axis extending along said outlet pipe.

8. The fuel tank according to claim 1, wherein said fuel collection container and said outlet pipe are monolithically integral with one another as a unitary one-piece component.

9. The fuel tank according to claim 1, wherein said fuel collection container excludes any sieve and excludes any screen.

10. The fuel tank according to claim 1, wherein said fuel reservoir space has a configuration bounded by an acute angle relative to a plane extending perpendicularly to a symmetry axis of said tank wall.

11. The fuel tank according to claim 1, wherein said fuel collection container includes a container wall that bounds said fuel reservoir space, said first area is a first wall area of said container wall through which said fuel flow channels open into said fuel reservoir space, and said second area is a second wall area of said container wall along which said grooves extend.

12. The fuel tank according to claim 11, wherein said first wall area and said second wall area of said container wall each respectively extend at a respective acute angle relative to a plane that extends perpendicularly relative to a longitudinal axis extending along said outlet pipe.

13. The fuel tank according to claim 12, wherein said container wall is a conical container wall including said first and second wall areas extending at said respective acute angle.

14. The fuel tank according to claim 12, wherein said fuel collection container further includes a disk-shaped plate that has a plate wall extending along said plane, with said fuel reservoir space bounded between said plate wall and said container wall, and with said fuel feed passages extending between said plate wall and said container wall.

15. The fuel tank according to claim 1, containing an amount of said liquid fuel that corresponds to less than half of a volume of said tank interior space and that fills said tank interior space to a certain fill level, and containing an amount of said propellant gas in said tank interior space above said certain fill level, wherein said fuel tank is arranged in a gravitational environment and is oriented with a longitudinal axis of said outlet pipe extending horizontally, and wherein said certain fill level of said liquid fuel in said tank interior space is below and spaced away from said outlet pipe and said fuel collection container such that said fuel collection container is exposed to said propellant gas.

* * * * *